US006575619B1

(12) United States Patent
Stauffer

(10) Patent No.: US 6,575,619 B1
(45) Date of Patent: Jun. 10, 2003

(54) METHOD FOR ASSEMBLING A CASING RING IN A WATCH CASE AND CASING RING FOR SUCH METHOD

(75) Inventor: Philippe Stauffer, Neuchâtel (CH)

(73) Assignee: Eta SA Fabriques d'Ebauches, Grenchen (CH)

( * ) Notice: Subject to any disclaimer, the term of this patent is extended or adjusted under 35 U.S.C. 154(b) by 0 days.

(21) Appl. No.: 09/552,508

(22) Filed: Apr. 19, 2000

(30) Foreign Application Priority Data

Apr. 22, 1999 (EP) ..... 99107968

(51) Int. Cl.[7] ..... G04B 37/00

(52) U.S. Cl. ..... 368/299; 368/88; 368/297; 29/896.3

(58) Field of Search ..... 368/299, 88, 276, 368/281, 287, 297, 298, 300, 291, 311; 29/896.3

(56) References Cited

U.S. PATENT DOCUMENTS

| | | | | | |
|---|---|---|---|---|---|
| 3,520,130 | A | * | 7/1970 | Oltramare | 368/287 |
| 3,633,356 | A | * | 1/1972 | Kitazima et al. | 368/299 |
| 3,727,367 | A | * | 4/1973 | Fujimori et al. | 368/287 |
| 3,817,025 | A | * | 6/1974 | Siegrist | 368/296 |
| 4,110,970 | A | * | 9/1978 | Funazawa et al. | 368/291 |
| 4,184,317 | A | * | 1/1980 | Kanda et al. | 368/300 |
| 4,205,523 | A | * | 6/1980 | Ida | 368/281 |
| 4,207,735 | A | * | 6/1980 | Ishigaki et al. | 368/300 |
| 4,626,108 | A | * | 12/1986 | Ganter | 368/300 |
| 6,170,982 | B1 | * | 1/2001 | Graber | 368/311 |
| 6,213,635 | B1 | * | 4/2001 | Savy et al. | 368/299 |
| 6,357,908 | B1 | * | 3/2002 | Hunziker | 368/287 |

FOREIGN PATENT DOCUMENTS

| | | | | |
|---|---|---|---|---|
| CH | 688 926 G | | 6/1998 | |
| EP | 0 549 978 | | 7/1993 | |
| JP | 55033648 | * | 3/1980 | 368/291 |
| JP | 57084379 | * | 5/1982 | 368/299 |

OTHER PUBLICATIONS

DE 70 00 980 U (Blessing–Werke, KG), p. 4, line 9–22. Apr. 23, 1970.

*Patent Abstract of Japan,* vol. 12, No. 384 (M–753), Oct. 13, 1988 (JP 63 135649). Jun. 8, 1988.

* cited by examiner

*Primary Examiner*—Vit Miska
*Assistant Examiner*—Jeanne-Marguerite Goodwin
(74) *Attorney, Agent, or Firm*—Griffin & Szipl, P.C.

(57) ABSTRACT

The method for assembling and fixing a casing ring (3) in a watch case (6) uses a ring made of plastically deformable material fitted with means (60, 70) forming a single piece with the ring and capable of positioning it with respect to the case. The ring is introduced into the case, which causes said positioning means to be deformed plastically. The introduction is interrupted when the ring occupies a determined position with respect to the case.

13 Claims, 4 Drawing Sheets

METHOD FOR ASSEMBLING A CASING RING IN A WATCH CASE AND CASING RING FOR SUCH METHOD

FIELD OF THE INVENTION

The present invention concerns a method for assembling and fixing a casing ring in a watch case, said case including a back cover and a middle part. It also concerns a casing ring manufactured to satisfy this assembly method.

BACKGROUND OF THE INVENTION

Assembling a casing ring in a watch case has already been proposed, the ring being designed in such a way that it contains, in itself, all the means which fix it to the case without it being necessary to use additional means, such as, for example, screws or fixing clamps.

The document CH 688 926 discloses a clockwork movement housed in a casing ring whose periphery has raised portions and whose peripheral wall has recesses situated facing these raised portions so as to allow the ring to be deformed elastically in the raised portions regions when the ring is introduced into the case. It is thus possible to obtain perfect radial fitting of the movement in its case without it being necessary to respect strict tolerances. This document also proposes means for positioning the height of the ring with respect to the case, the axial fitting of such means being also achieved by raised portions which abut against the back cover of the case, these raised portions being followed by recesses made in the thickness of the ring and allowing said raised portions to be deformed elastically. The vertical play of the ring with respect to the case can thus be regained.

The design described above has several drawbacks. It will be mentioned first of all that the presence of the recesses necessary to allow the raised portions to be deformed elastically results in a ring of large thickness, and thus to a watch of large diameter for a given movement. It will be mentioned next that, if it is in fact possible to obtain perfect radial fitting of the movement in its case, it is not possible to assure a determined and precise radial positioning of the movement with respect to the case. Finally, it will be observed that if the vertical play of the ring with respect to the case is regained, it is at the cost of a constant thrust of the ring against the crystal which is then liable to be driven out of the middle part.

SUMMARY OF THE INVENTION

In order to avoid the aforecited drawbacks, the method for assembling and fixing the casing ring according to the invention is characterised in that it includes the following series of steps:

- providing a casing ring made of a plastically deformable material, said ring being provided with integrated means forming a single piece with the ring and capable of positioning it with respect to the case;
- introducing the ring into the case, which causes said positioning means to be deformed plastically; and
- interrupting the introduction when the ring occupies a determined position with respect to the case.

Thus, it is clear that the method of the invention also relies on a material able to be deformed plastically, and not elastically, as a result of which the aforementioned drawbacks can be avoided. The ring is then of small thickness, it can be positioned precisely in the case and does not exert any thrust tending to push the crystal out of its housing.

The present invention also concerns a casing ring manufactured to satisfy the assembly method described above.

BRIEF DESCRIPTION OF THE DRAWINGS

The advantages and the interest of the present invention will be explained now with reference to the following description and the drawings which illustrate it by way of non limiting example and in which.

DETAILED DESCRIPTION OF THE INVENTION

Figure 1:
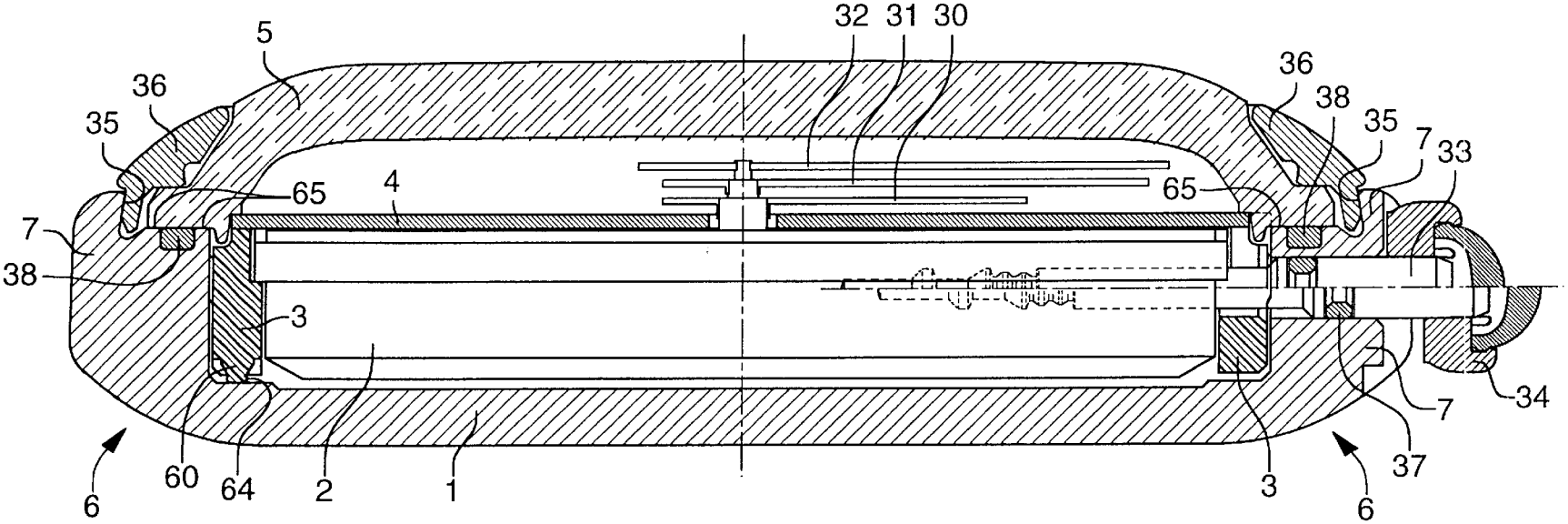
FIG. 1 is a general cross-section of the watch assembled according to the invention.

The timepiece of the invention is shown in cross-section in FIG. 1. It includes a movement 2 mounted in a casing ring 3, a dial 4 mounted on ring 3 and a crystal 5 mounted above dial 4. Ring 3 is mounted in a case 6 including a middle part 7 and a back cover 1 formed in a single piece with the middle part. Crystal 5 rests on the top of middle part 7 and is secured thereto by a bezel 36 held in a notch 35. More particularly, movement 2 is fitted with hours, 30, minutes, 31, and seconds, 32, hands which move between dial 4 and crystal 5. The movement also includes a time-setting stem 33 on which is fitted a crown 34. The sealing of stem 33 as regards middle part 7 is assured by an O ring gasket 37. Crystal 5 is sealed with respect to case 6 by the use of a sealing gasket 38 wedged between the top of middle part 7 and crystal 5. Ring 3 is mounted in case 6 in accordance with the assembling and fixing method which will now be described.

Figure 3:
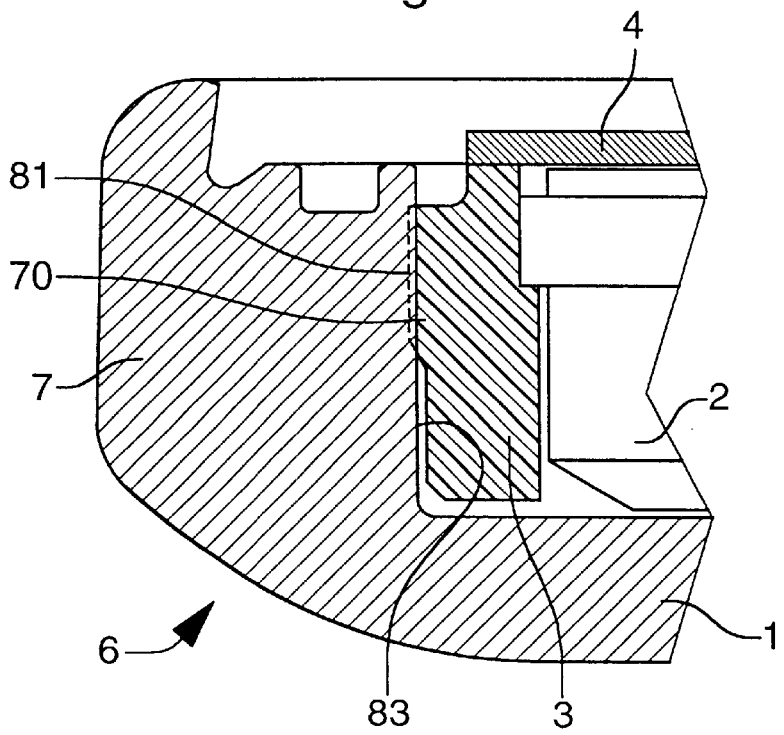
FIG. 3 is a cross-section along the line III—III of FIG. 2.
Figure 4:
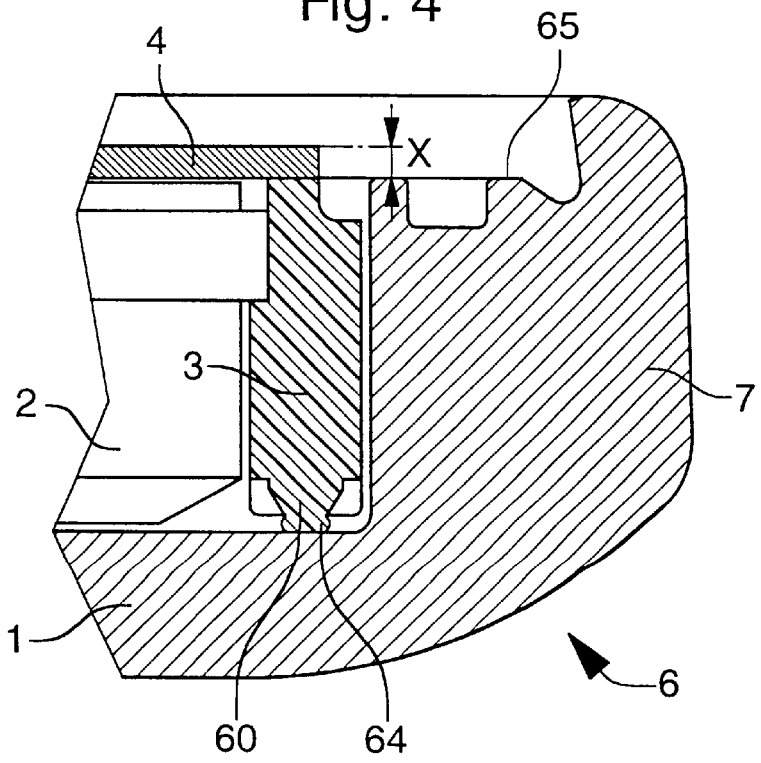
FIG. 4 is a cross-section along the line IV—IV of FIG. 2.

Reference will be made more specifically for this purpose to FIGS. 2, 3 and 4. First of all a casing ring 3 made of a plastically deformable material is provided. It may be for example a material known by the name of Hostaform®. Ring 3 is fitted with integrated positioning means, made in a single piece with the ring, these means being able to position ring 3 with respect to case 6. These means are referenced 60 in FIG. 4 and 70 in FIG. 3, these Figures being cross-sections respectively along lines IV—IV and III—III of FIG. 2. This having been achieved, and after having housed movement 2 in ring 3, ring 3 is introduced into case 6, which will cause plastic deformation of positioning means 60 and 70. Finally, the introduction of the ring into the case is interrupted when the ring occupies a determined position with respect to the case.

This is a description of the invention in its most general sense. A particular embodiment of the invention putting this general definition into practice will be seen in detail hereinafter. However, the difference which exists between the present invention and the embodiment described above with reference to the aforecited document, can already be pointed out at this stage of the description. The present invention involves plastic deformation of the positioning means, this deformation resulting in an irreversible crushing of the material. In fact, when the ring is in place, it is positioned exactly and is not subjected to any thrust, be it radial or axial, as would be the case if the positioning means were elastically deformed.

In order to position the ring exactly with respect to the case, a first device has to be provided allowing it to be situated in height with respect to the case and a second device allowing it to be centred with respect to the case. The first device can rely, according to the invention, upon plastic deformation and the second upon different means known to those skilled in the art. Conversely, this first device may use means known to the watchmaker and the second can rely upon plastic deformation in accordance with the present invention. In the embodiment which will now be described, both first means 60 for positioning the ring axially with respect to the case and second means 70 arranged for positioning the ring radially with respect to the case, rely upon plastic deformation.

Figure 8:
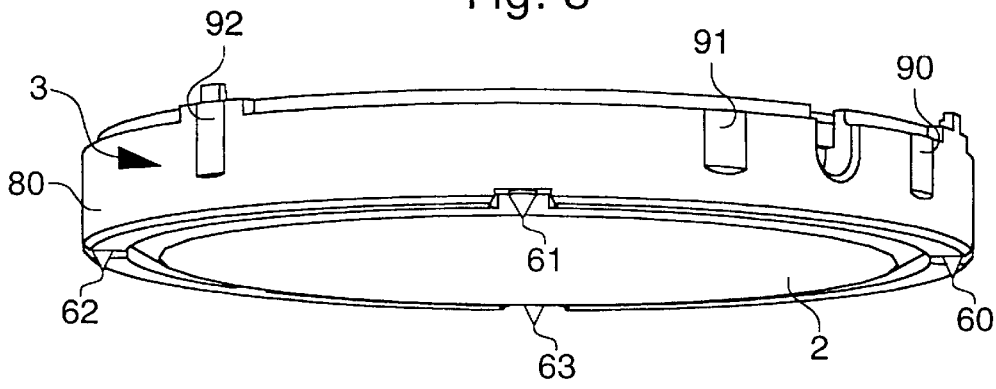
FIG. 8 is a perspective view showing the casing ring seen from below.
Figure 9:
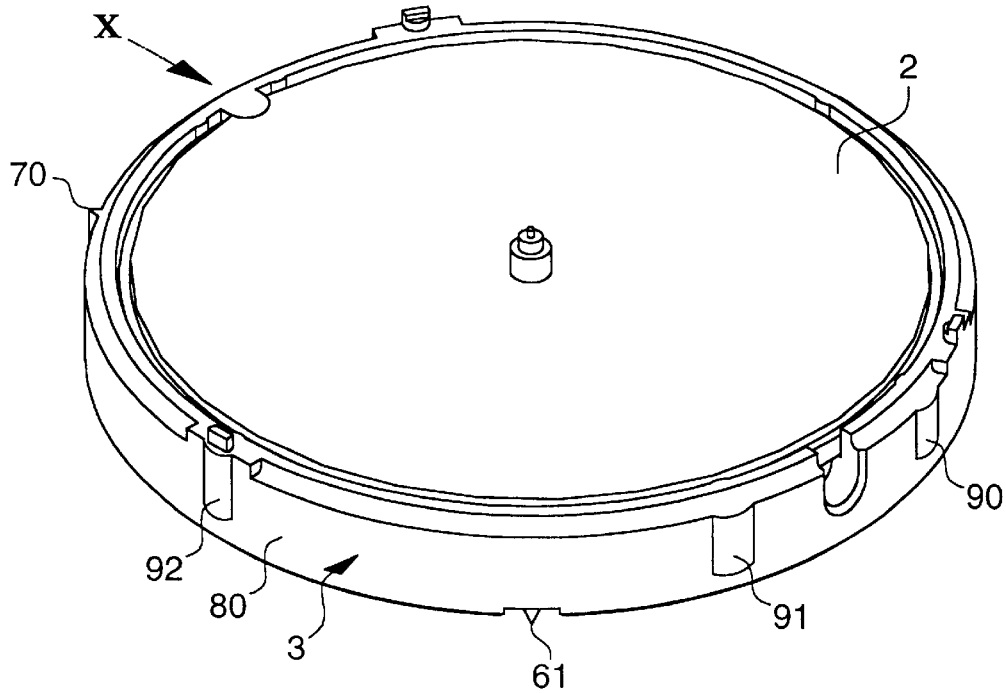
FIG. 9 is a perspective view showing the casing ring seen from above.

If one refers to FIGS. 8 and 9, the first means allowing ring 3 to be positioned axially with respect to case 6 consist of a plurality of spikes 60, 61, 62 and 63 in the shape of cones and arranged underneath ring 3. Four spikes have been selected here and arranged at an equal distance from each other to assure proper seating of ring 3 on back cover 1. When ring 3 is placed in case 6, spikes 60 to 63 are crushed and plastically deformed against back cover 1 of the case until the ring occupies a determined axial position with respect to the case. At that moment, cones 60 to 63 no longer end in spikes as shown in FIG. 8, but in bulges 64, as can be seen in FIGS. 1 and 4.

As was mentioned hereinbefore and as shown in FIG. 1, a dial 4 rests on ring 3 and a crystal 5, capable of being fixed to case 6 by a bezel 36 rests on dial 4. The assembly thereby formed is introduced into the case until crystal 5 abuts the top 65 of middle part 7, following which bezel 36 is placed in its notch 35 which has the effect of securing the crystal onto the case. In the event that another design is selected, wherein the crystal cannot be used as a reference dimension with respect to the case, the assembly formed by movement 2, ring 3 and dial 4 can be introduced by means of an intermediate tool until a determined height dimension is reached, for example dimension X shown in FIG. 4, this dimension marking the distance between the top of dial 4 and top 65 of middle part 7.

It is clear that the assembly method which has just been described removes all the inherent plays to the dimensional tolerances of dial 4, ring 3 and back cover 1 of case 6. This is how the irregularities of back cover 1 are completely neutralised. It is also clear that the plastic crushing of spikes 61 to 63, due to their irreversible deformation, does not cause any vertical thrust which would tend to push out bezel 36 from its notch 35.

Figure 10:
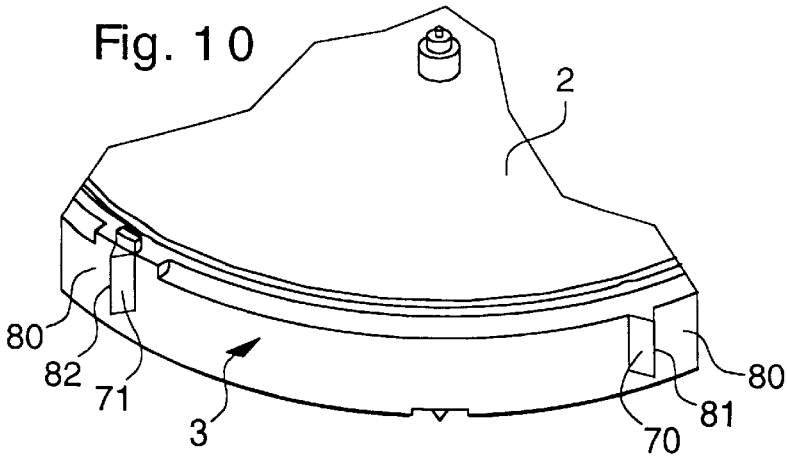
FIG. 10 is a perspective view along the arrow X of FIG. 9.

The second means allowing to position ring 3 radially and fix it with respect to case 6 will now be discussed. These means are apparent in FIGS. 2, 3, 9 and 10. If reference is made more particularly to FIG. 10, which is a perspective view along arrow X of FIG. 9, it can be seen that the second means consist of two prisms 70 and 71 which emerge from outer wall 80 of ring 3. These prisms, whose volume has been greatly exaggerated here to make them clear, are elongated in the direction of the axis of the ring and each have an edge 81 and 82. It is these edges which will be crushed and deformed plastically against inner wall 83 of middle part 7 when ring 3 is introduced into case 6. This situation is shown in FIG. 3 where the dotted line shows edge 81 of prism 70 prior to deformation. After this introduction, ring 3 is radially positioned and fixed in case 6.

Figure 2:
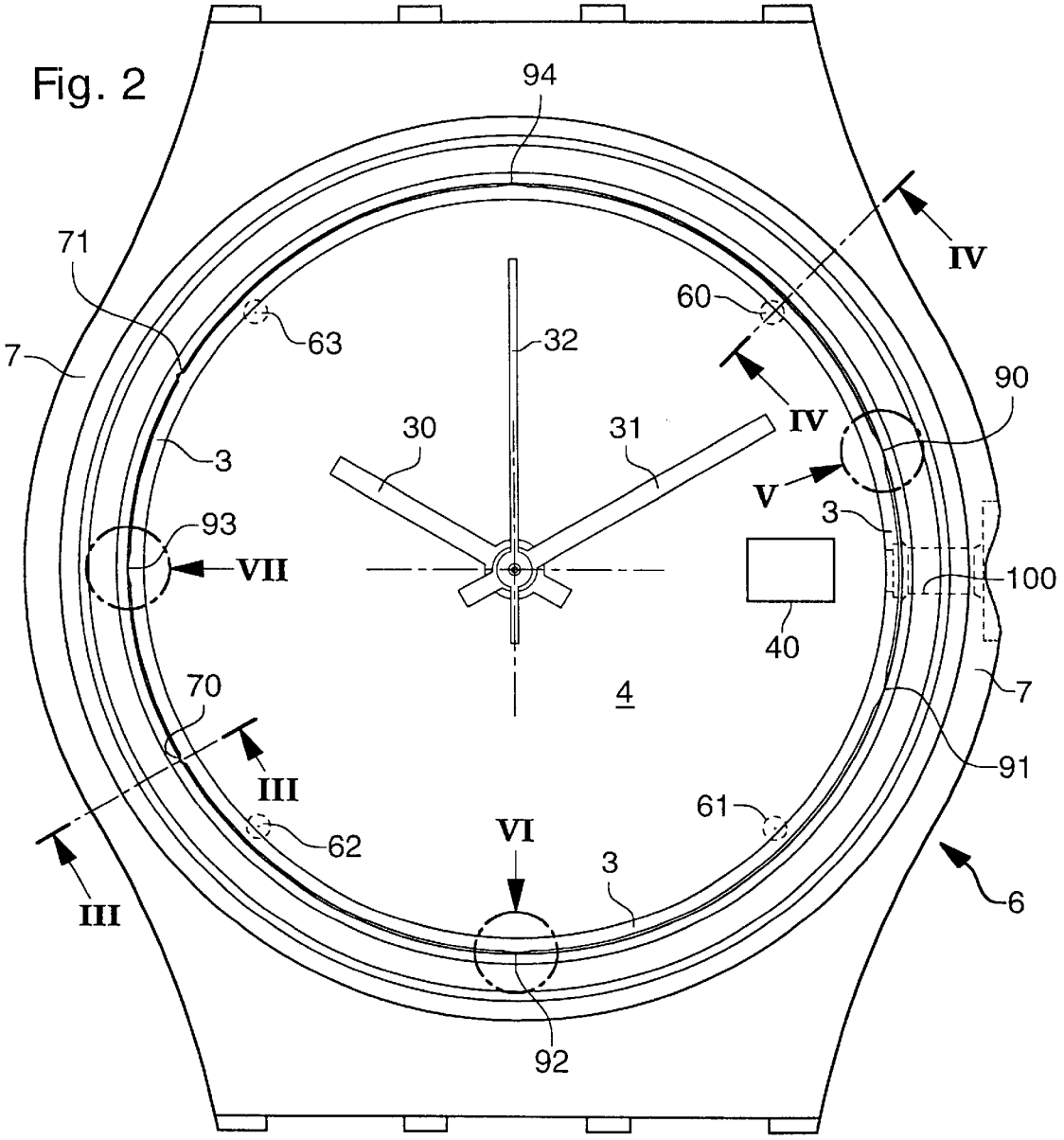
FIG. 2 is a plane view of the watch of FIG. 1, shown here without its crystal and bezel.
Figure 5:
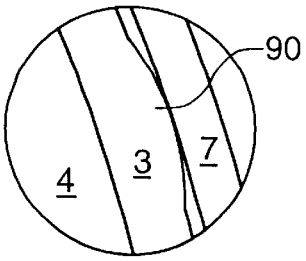
FIG. 5 is an enlargement of zone V of FIG. 2.
Figure 6:
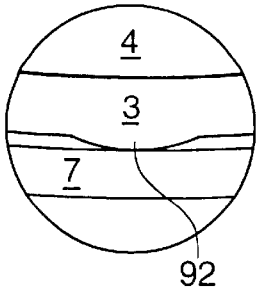
FIG. 6 is an enlargement of zone VI of FIG. 2.

FIG. 2 shows that prisms 70 and 71 are situated on either side of the ring's 9 o'clock position. This arrangement allows ring 3 to be positioned accurately in a reference region which is situated at 3 o'clock, where stem 33 is located (FIG. 1), window 40 of the calendar (FIG. 2) and the lens (not shown) of the crystal being mounted above this window if it exists.

Figure 7:
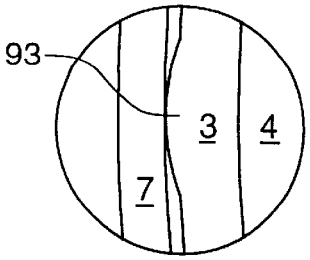
FIG. 7 is an enlargement of zone VII of FIG. 2.

In order to assure an exact position of ring 3 with respect to case 6, the Figures show raised portions 90 to 94 which are elongated in the direction of the axis of the ring and distributed over outer wall 80 of this ring. They are formed so as not to deform when the ring is introduced into the case. In particular and as FIGS. 2, 5, 8 and 9 show, two raised portions 90 and 91 are situated on either side of the 3 o'clock position in order to guarantee a precise position of the ring with respect to stem 33 whose passage orifice 100 can be seen in FIG. 2. Likewise, raised portions 92 and 94 assure a precise position of ring 3 along the midday-6 o'clock axis. Finally, raised portion 93 (see FIG. 7), situated at 9 o'clock prevents the ring being driven in this direction if stem 33 is subjected to a shock, which would cause even more pronounced crushing of prisms 70 and 71 and consequently the ring to be loose in the case.

It will be observed that a single prism 70 situated at 9 o'clock could suffice provided that it is surrounded by two raised portions. In this version, and if reference is made to FIG. 2, raised portion 93 would be replaced by a prism and prisms 70 and 71 would each be replaced by a raised portion. Thus, in this case, the second means would consist of a single prism emerging from the outer wall of the ring.

It is clearly understood that the present invention also concerns the casing ring as such which allows the assembly described hereinbefore. This ring is made of plastically deformable material. It includes spikes 90 to 93 arranged underneath it which are crushed and plastically deformed against back cover 1 to assure a determined axial position of the ring. The ring includes finally at least one prism 70 which emerges from its outer wall 80, these prisms each having an edge 81 which is crushed and plastically deformed against inner wall 83 of middle part 7 to assure a determined radial position and to fix the ring in the case.

What is claimed is:

1. A method for assembling and fitting a casing ring in a watch case, wherein the case includes a back cover and a middle part, the method comprising the steps of:

providing a casing ring made of a plastically deformable material and comprising integrated positioning means made in a single piece with the ring, for positioning the ring with respect to a watch case;

introducing the ring into the watch case, whereby introducing the ring into the watch case plastically deforms the positioning means; and interrupting the introducing of the ring into the case when the ring occupies a determined position with respect to the case.

2. A method according to claim 1, wherein providing a casing ring provides the casing ring having the integrated positioning means, the integrated positioning means comprising first means arranged to position the ring axially with respect to the case and second means arranged to position the ring radially with respect to the case so that introducing the ring into the watch case positions the ring both axially and radially with respect to the case.

3. A method according to claim 2, wherein the first means consist of a plurality of spikes in the shape of cones arranged underneath the ring so that introducing the ring into the case progressively crushes and plastically deforms each spike of the plurality of spikes against the back cover of the case until the ring occupies the determined position with respect to the case.

4. A method according to claim 3, wherein the method further includes providing a dial that rests on the ring and a crystal that rests on the dial so that the casing ring, the dial, and the crystal form one assembly, and wherein introducing the casing ring into the case further includes introducing the dial, the crystal and the casing ring as one assembly into the case until the crystal rests on a middle part of the case, followed by fixing the crystal to the case by snap fitting the bezel to the middle part of the case.

5. A method according to claim 3, wherein introducing the ring into the case irreversibly deforms the plurality of spikes so that each spike forms a bulge.

6. A method according to claim 2, wherein the second means comprises at least one prism which emerges from the outer wall of the ring and is elongated in the direction of an axis of the ring, and the at least one prism has an edge so that introducing the ring into the case crushes and plastically deforms the edge against an inner wall of the middle part of the case.

7. A method according to claim 6, wherein the ring has a 9 o'clock position located on the ring, the watch case has a 3 o'clock position located on the watch case and a stem located at the 3 O'clock position, and the second means comprises the at least one prism and a second prism disposed on the ring on either side of the 9 o'clock position so that introducing the ring into the case positions the ring in a reference region located at the 3 o'clock position of the case.

8. A method according to claim 6, wherein the determined position includes a determined radial position and a determined axial position, and the ring has a plurality of raised portions elongated along the axis of the ring and which emerge from an outer wall of the ring so that introducing the ring into the case assures exact positioning of the ring at the determined radial position of the determined position.

9. A method according to claim 8, wherein introducing the ring into the case deforms the at least one prism and does not deform the plurality of raised portions.

10. A casing ring assembly for a watch, the casing ring assembly comprising:

a ring having an inner wall, an outer wall, a top surface, an underneath surface and an axis;

a first means for axial positioning, the first means being disposed on the underneath surface; and a second means for radial positioning, the second means being disposed on the outer wall, wherein the first means and the second means form an integrated positioning means that is made in a single piece with the ring and the assembly is made of plastically deformable material.

11. A casing ring assembly according to claim 10, further comprising a plurality of non-deforming raised portions disposed on the outer wall and elongated along the axis of the ring.

12. A casing ring assembly according to claim 10, wherein the first means comprises a plurality of spikes, each spike being cone shaped and prone to irreversible deformation.

13. A casing ring assembly according to claim 10, wherein the second means comprises at least one prism, the at least one prism emerging from the outer wall and elongated along the axis of the ring, and the at least one prism having an edge that is prone to irreversible deformation.

* * * * *